US006508019B1

(12) United States Patent
Sasaki et al.

(10) Patent No.: US 6,508,019 B1
(45) Date of Patent: Jan. 21, 2003

(54) BOOM OF BUCKET TYPE EXCAVATOR AND METHOD FOR MAKING SAME

(75) Inventors: Hidetoshi Sasaki, Kawasaki; Toshio Tanaka, Hirakata; Tatsushi Itoh, Hirakata; Nobuyoshi Masumoto, Hirakata, all of (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/484,716

(22) Filed: Jan. 18, 2000

Related U.S. Application Data

(63) Continuation of application No. PCT/JP98/03181, filed on Jul. 15, 1998.

(30) Foreign Application Priority Data

Jul. 15, 1997 (JP) ..... 9-189431

(51) Int. Cl.[7] ..... B66C 23/64; B66C 23/683; B66C 23/687; B66C 23/70

(52) U.S. Cl. ..... 37/466; 212/347

(58) Field of Search ..... 212/347, 348, 212/349, 350, 230, 264; 52/118; 37/411, 466

(56) References Cited

U.S. PATENT DOCUMENTS 2,283,443 A * 5/1942 Klein ..... 212/142
2,833,422 A * 5/1958 Ferwerda et al. ..... 212/55
3,082,881 A * 3/1963 Wieger ..... 212/55
3,622,013 A * 11/1971 Swanson et al. ..... 212/55
3,648,640 A * 3/1972 Granger ..... 114/66.5 R
3,802,136 A * 4/1974 Eiler et al. ..... 52/115
3,960,285 A * 6/1976 Gano ..... 214/141
3,979,873 A * 9/1976 Coles ..... 52/632
4,069,637 A 1/1978 Braithwaite ..... 52/726
4,159,796 A 7/1979 Braithwaite ..... 228/151
4,168,008 A * 9/1979 Granryd ..... 212/144
4,238,911 A * 12/1980 Mazur ..... 52/111
4,309,854 A * 1/1982 Vendramini ..... 52/121
4,712,697 A * 12/1987 McGowan ..... 212/189
4,728,249 A * 3/1988 Gano ..... 414/718
5,628,416 A * 5/1997 Frommelt et al. ..... 212/292
5,865,328 A * 2/1999 Kaspar ..... 212/350
5,884,791 A * 3/1999 Vohdin et al. ..... 212/348
6,098,824 A * 8/2000 Krebs et al. ..... 212/347

FOREIGN PATENT DOCUMENTS

EP 0450543 A1 * 10/1991

* cited by examiner

*Primary Examiner*—Christopher J. Novosad
(74) *Attorney, Agent, or Firm*—Darby & Darby

(57) ABSTRACT

A boom body (23) comprises a boom front member (20), a boom intermediate member (22) and a boom rear member (21). An arm-connection bracket (24) is jointed to the boom front member (20) and a vehicle body-mounting bracket (25) is jointed to the boom rear member (21), thereby forming a boom. With this structure, a cross section of the boom body (23) is less prone to be deformed and therefore, the plate thickness can be reduced, the rigidity of the boom body (23) can be increased without mounting a cross section restraint material and the cross section of the boom is not deformed. Therefore, it is possible to reduce the boom in weight.

5 Claims, 22 Drawing Sheets

BOOM OF BUCKET TYPE EXCAVATOR AND METHOD FOR MAKING SAME

This application is a continuation of PCT/JP98/03181 filed Jul. 15, 1998, published as WO 99/04103 on Jan. 28, 1999.

TECHNICAL FIELD

The present invention relates to a boom of a bucket type excavator such as a hydraulic shovel and a method for making such boom.

BACKGROUND OF THE INVENTION

As shown in FIG. 1, in a hydraulic shovel of a bucket type excavator, an upper vehicle body 2 is turnably mounted on a lower running body 1, a boom 3 is vertically swingably mounted to the upper vehicle body 2, an arm 4 is vertically oscillatably mounted to the boom 3, and a bucket 5 is vertically oscillatably mounted to a tip end of the arm 4. A boom cylinder 6 is connected between the upper vehicle body 2 and the boom 3, an arm cylinder 7 is connected between the boom 3 and the arm 4, and a bucket cylinder 8 is connected between the arm 4 and the bucket 5.

The hydraulic shovel vertically swings the boom 3, the arm 4 and vertically oscillates the bucket 5, and at the same time, laterally turns the upper vehicle body 2, for carrying out operations such as excavation and loading to a dump truck.

As shown in FIG. 2, the boom 3 comprises a boom body 10 of boomerang shape as viewed from side, a vehicle body-mounting bracket 11 connected to one longitudinal end of the boom body 10, and an arm-connection bracket 12 connected to the longitudinally other end of the boom body 10. As shown in FIG. 3, the boom 10 is formed into a hollow structure of rectangular cross section in which an upper lateral plate 13, a lower lateral plate 14, and left and right vertical plates 15 and 15 are welded at right angles to one another so as to reduce the boom body 10 in weight.

At the time of excavation, the boom 3 is driven in the vertical direction for inserting the bucket into earth and sand, a vertical load F1 is applied to the boom 3 as shown in FIG. 1. When the excavator turns around the upper vehicle body 2 for loading the dipped up earth and sand onto a dump truck or the like, a lateral load F2, and a torsion load F3 are applied to the boom 3. Therefore, the boom 3 is formed such that the boom 3 can withstand the loads and is not deformed. For example, against the vertical load F1, a height H is increased as compared with a width W as shown in FIG. 3. Against the lateral load F2 and the torsion load F3, a partition wall 16 is connected such that an opened box-like structure is formed as shown in FIG. 3, and a vertical plate of a boom cylinder boss 18 is provided with a cross section restraint material such as a pipe 17 (FIG. 4) for dispersing the torsion force and load.

In the hydraulic shovel, a counter weight 9 is provided at a rear portion of the upper vehicle body 2 in accordance with the excavation ability of a working machine comprising the upper vehicle body 2 which is a main portion, the boom 3, the arm 4 and the bucket 5. If the working machine is reduced in weight, the weight of the counter weight 9 can be reduced, the rearward projecting amount of the upper vehicle body 2 can be reduced and therefore, a turning radius of the rear end of the upper vehicle body 2 can be reduced.

If the working machine comprising the boom 3, the arm 4 and the bucket 5 is reduced in weight, it is possible to increase the volume of the bucket correspondingly and thus to increase the working load capacity.

Further, the boom 3 is vertically swung by the boom cylinder 6, and a portion of a thrust of the boom cylinder 6 supports the weight of the boom 3. Therefore, if the boom 3 is reduced in weight, the thrust of the boom cylinder 6 effectively can be utilized as the vertical swinging force of the boom 3.

In general, when considering a strength of the working machine of the bucket type excavator, as the simplest method, a working machine is replaced with a beam or a thin pipe which is discussed in material mechanics and a strength with respect to the bending and torsion can be evaluated.

That is, bending stress s, and shearing stress t generating on a cross section can be obtained by the following general formulas (1) and (2):

$$s=M/Z \tag{1}$$

(wherein, s: bending stress generating on a cross section, M: bending moment applied to the cross section, Z: cross section coefficient)

$$t=T/2At \tag{2}$$

(wherein, t: shearing stress, T: torsion torque, A: projection area of neutral line of cross section plate thickness, t: thickness of cross section plate)

An appropriate shape of the cross section can be determined from the results of the above calculation and permissible stress of the material to be used. Similarly, deflection of the beam and torsion of the axis can be calculated using general formula of the material mechanics, and such calculation, rigidity of the working machine can also be evaluated.

However, if a working machine designed in accordance with the above evaluation method is actually produced and a stress test is carried out, the result of the test is different from a stress value calculated during the evaluation in many cases. For this reason, in recent years, simulation by a computer using finite element method (FEM) is employed as the evaluation method for enhancing the precision of the stress evaluation. If the stress is calculated using the FEM simulation, it can be found that a cross section of a working machine which was considered as beam and axis of material mechanics is changed in shape before and after the load is applied. From this fact, it can be understood that a stress calculated using the general formulas of the material mechanics derived based on a presumption that a shape of a cross section is not changed and a stress measured when a stress test is actually carried out do not coincide with each other.

In the case of a conventionally used working machine having a rectangular cross section, there are two factors for determining a deformation strength of the cross section, i.e., rigidity of a rectangular angle portion and rigidity of a rectangular side portion in the outward direction of a surface. When each of the two rigidity does not have sufficient strength against a load, the cross section is deformed as shown in FIG. 5, and an excessive load is applied to the rectangular angle portion. To prevent those, a cross section restraint material such as a partition wall is required for a portion in which its cross section is deformed, but if such material is provided, productivity of the working machine is lowered.

If the above facts are applied to the boom 3, the boom 3 is of hollow shape of rectangular cross section as shown in FIG. 3, rigidity of the cross section is determined by bending rigidity of an angle portion a, bending rigidity (rigidity in the outward direction of surfaces) of the four surfaces (the upper lateral plate 13, the lower lateral plate 14, and the left and right vertical plates 15 and 15). That is, influence of the bending rigidity of the surfaces and the bending rigidity of the angle portion is great with respect to the deformation of the cross section. For example, in FIG. 3, when the lower plate 14 is fixed, and a load F shown with the arrow F is applied, as shown in FIG. 5 schematically, each of the angle portions a is bent and deformed, the upper plate 13 and the left and right vertical plates 15 and 15 are bent and deformed in the outward direction of the surfaces (thickness direction). When the thickness of the plate is reduced, reduction of rigidity in the outward direction of the surface is proportional to the third power of a ratio of reduction of the plate thickness.

For these reasons, if the thickness of each plate is reduced to increase the cross section, when the lateral load F2 and the torsion load F3 are applied to the boom 3, a deformation is generated in the light weight boom 3 as shown with the arrows b and c in FIG. 3, and the rigidity of the entire boom is largely lowered. Therefore, the above-described cross section restraint material such as the partition wall 16 and the pipe 17 must be reinforced, the weight of the boom is increased because of the reinforced cross section restraint material, the structure is complicated because of the partition wall 16 and the pipe 17, and there is a problem with the productivity due to increase in welding requirements.

Further, as shown in FIG. 2, the boom 3 is provided with a boom cylinder boss 18 for connecting the boom cylinder 6, and an arm cylinder bracket 19 for connecting the arm cylinder 7. If the thickness of each of portions to which the boss 18 and the bracket 19 are to be connected, e.g., the left and right vertical plates 15, 15 and the upper lateral plate 13 is reduced, the rigidity in the outward direction of the surface is lowered. Therefore, in some cases, this further increases the deformation in the outward direction of the surface and reduces the rigidity of the boom 3, and a deformation shown with a phantom line in FIG. 3 is generated. Thus, it is difficult to reduce the thickness of plate material forming the boom body 10.

Further, since the plate members forming the boom body 10 are welded to one another at right angles, if the thickness of the plate members is reduced, the weld jointing efficient is lowered, and it is difficult to secure the durability of the angle joint and thus, it is difficult to reduce the thickness of the plate members forming the boom body 10.

Furthermore, in the case of the conventional boom, the upper lateral plate 13, the lower lateral plate 14 and the left and right vertical plates 15, 15 are formed by cutting them in accordance with the shape of the boom body 10, and the vehicle body-mounting bracket 11 and the arm-connection bracket 12 are welded to the boom body 10. Therefore, working of each of the plate members is complicated, the welding portion (welding line) is long, many steps are required to produce the boom and thus, the producing method is complicated.

A boom shown in FIG. 6 in which one sheet of plate is bent into U-shape and the upper lateral plate 13 and the left and right vertical plates 15, 15 are formed into one unit is known. However, in this case also, a step for cutting the plate and the lower lateral plate 14, a step for bending, and a step for welding two welding portions (welding lines) are required and thus, many steps are required and this method is complicated.

Therefor, it is an object of the present invention to provide a boom of a bucket type excavator and a method of making same which can solve the above problems.

SUMMARY OF THE INVENTION

In a boom of a bucket type excavator of a first embodiment of the invention having a boomerang-like shape in which a base end of the boom is mounted to a vehicle body and an arm is mounted to a tip end of the boom, a boom body is hollow and triangular in cross section.

According to the first embodiment, since the boom body 23 is triangular in cross section, due to characteristics of a triangle that its cross section is less prone to be deformed in the outward direction of surface by load, the boom body 23 can keep its cross section shape and secure rigidity therein without using a cross section restraint material such as a pipe. Therefore, the plate thickness of the boom body 23 can be reduced to reduce its weight, and the cross section restraint material such as a partition wall and the pipe is unnecessary and thus, its structure is simple, and the number of portions requiring welding is small and therefore, durability and productivity are enhanced. Therefore, the weight of the boom can be reduced, and excellent durability and productivity achieved.

In a boom second embodiment, the boom body has a cross section of the first embodiment in which three sides are straight, and each of connected portions of the two sides is of arcuate shape.

According to the second embodiment, since the cross section of the boom body 23 in which the three sides are straight, and each of connected portions of the two sides is of arcuate shape, the sectional area can be increased such that it inscribes a sectional area of a conventional boom, the cross section performance can be maintained, and since the angle portion is arcuate in shape, stress can be dispersed. Therefore, a large sectional area can be secured, the cross section performance can be maintained, and the rigidity of the boom is enhanced.

In a boom of a third embodiment, the boom body 23 has a triangle cross section of the second embodiment in which a lower surface thereof is a triangular base side, and an upper surface thereof is an apex of the triangle.

When the boom is curved downward into a boomerang shape and a vertical size of its intermediate portion is greater than those of opposite ends, the boom has properties that if a lateral load (F2 in FIG. 1) or a torsion load (F3 in FIG. 1) is applied to a tip end of the boom, length of a force transmitting path of the upper surface side is longer than that of the lower surface side and therefore, there is a tendency that a burden of a load of the lower surface side which is shorter in length is greater. Therefore, as in a third embodiment form, if the lower surface is formed into a base of a triangle, the cross section performance can be exhibited more efficiently as compared with a structure which is turned upside down, and the weight can further be reduced. When the weight reduction is taken into consideration, it is advantageous that the base is disposed at the shorter lower surface side as compared with a case in which the base having great weight is disposed at the longer upper surface side.

In a boom of a fourth embodiment, an arm cylinder bracket 26 is jointed to an upper surface of the arc connected portion of the two sides, and since the top of the boom body 23 has great rigidity, even if the plate thickness of the mounting portion of the arm cylinder bracket 26 is thin, the boom is not deformed. With this structure, the plate thickness of the mounting portion of the arm cylinder bracket 26 of the boom body 23 can be thin to further reduce the weight of the boom.

In a boom of a fifth embodiment, the boom body 23 has a substantially triangular cross section of the second embodiment in which a lower surface thereof is a triangular base side, an upper surface thereof an apex of the triangle, the top comprises two arcuate portions and a flat portion, and an arm cylinder bracket 26 is jointed to the flat portion of the top.

According to the fifth embodiment, since the top of the boom body 23 is a flat portion, when the arm cylinder bracket 26 is welded to the flat top, edge preparation of the arm cylinder bracket 26 is unnecessary and the throat depth of the weld joint can be secured by using a fillet weld joint. Therefore, the welding operation of the arm cylinder bracket 26 to the top of the boom body 23 is facilitated, and even if the plate thickness is thin, welding strength can be maintained.

In a sixth embodiment, and any one of the fourth and fifth embodiments, the boom body 23 is provided at its central portion with a pin fitting hole 45 for mounting a boom cylinder, an arm-connection bracket 24 is jointed to a tip end of the boom body 23, and a vehicle body-mounting bracket 25 is jointed to a base end of the boom body 23.

Since the boom body 23 is provided with the pin fitting hole 45, and the arm-connection bracket 24 and the vehicle body-mounting bracket 25 are welded to the boom body 23, the number of welding lines and constituent ports are small. Therefore, weight can further be reduced, and since the constituent parts is few, labor of management can be omitted. Further, when a vertical load (F1 in FIG. 1) is applied to such a boom, a portion of the boom body 23 which is closer to the front end than the pin fitting hole 45 receives a burden of load at its lower surface, and a portion of the boom body 23 which is closer to the vehicle body than the pin fitting hole 45 receives the burden of load at its upper surface side, but the tensile load on the front lower surface side, and the compressing load on the vehicle body side upper surface side are great. In terms of strength, since the tensile load is greater than the tensile load, if the cross section shape of the boom body 23 is formed such that its lower surface becomes a base side, it is advantageous with respect to deformation. It is necessary to guard against surface buckling for a portion where the compressing load is great (vehicle body side upper surface side), and it is advantageous against deformation such as surface buckling by disposing the top of the triangle on the above-described portion rather than disposing the base surface on this portion.

In a seventh embodiment, one longitudinal end of one boom front member 20 which is hollow and triangular in cross section and one longitudinal end of a boom rear member 21 which is hollow and triangular in cross section are connected to a boom intermediate member 22 having a pin fitting hole 45 with the same cross section shape as each of the cross sections, thereby forming the boom body 23, the arm-connection bracket 24 is jointed to the longitudinal other end of the boom front member 20, and the vehicle body-mounting bracket 25 is jointed to the longitudinal other end of the boom rear member 21.

Since the boom body 23 comprises the boom front member 20, the boom intermediate member 22 and the boom rear member 21, the handling is facilitated and large-scaled production facilities are unnecessary. That is, by dividing the boom body into the three elements, i.e., the boom front member 20, the boom intermediate member 22 and the boom rear member 21, the large-scaled production facilities are unnecessary and the handling is further facilitated.

A method for making a boom of a bucket type excavator according to the invention comprises the steps of: bending substantially rectangular plate material 62 having two long sides 60, 60 and two short sides 61, 61, thereby forming a hollow member which is triangular in cross section, and welding butted portions of the two long sides 60, 60, thereby forming a boom body 23.

Since one sheet of plate material is bent and the butted portions are welded to form the boom body 23, the working of the plate material is easy, and the welding portions (welding line) is short. With this method, the steps of making the boom body 23 are easy, and the boom can be produced with facility.

Further, according to the invention, the boom body 23 can have a cross section in which three sides are straight, and each of connected portions of the two sides is of arc shape, the boom body 23 has a triangle cross section in which a lower surface thereof is a triangular base side, an upper surface thereof is a tip of the triangle, and butt-welded portions of the two long sides are disposed on the lower surface. Because the welding portion is disposed on the lower surface, outward appearance can be enhanced as an added advantage of the invention.

DESCRIPTION OF THE PREFERRED EMBODIMENTS

Figure 7:
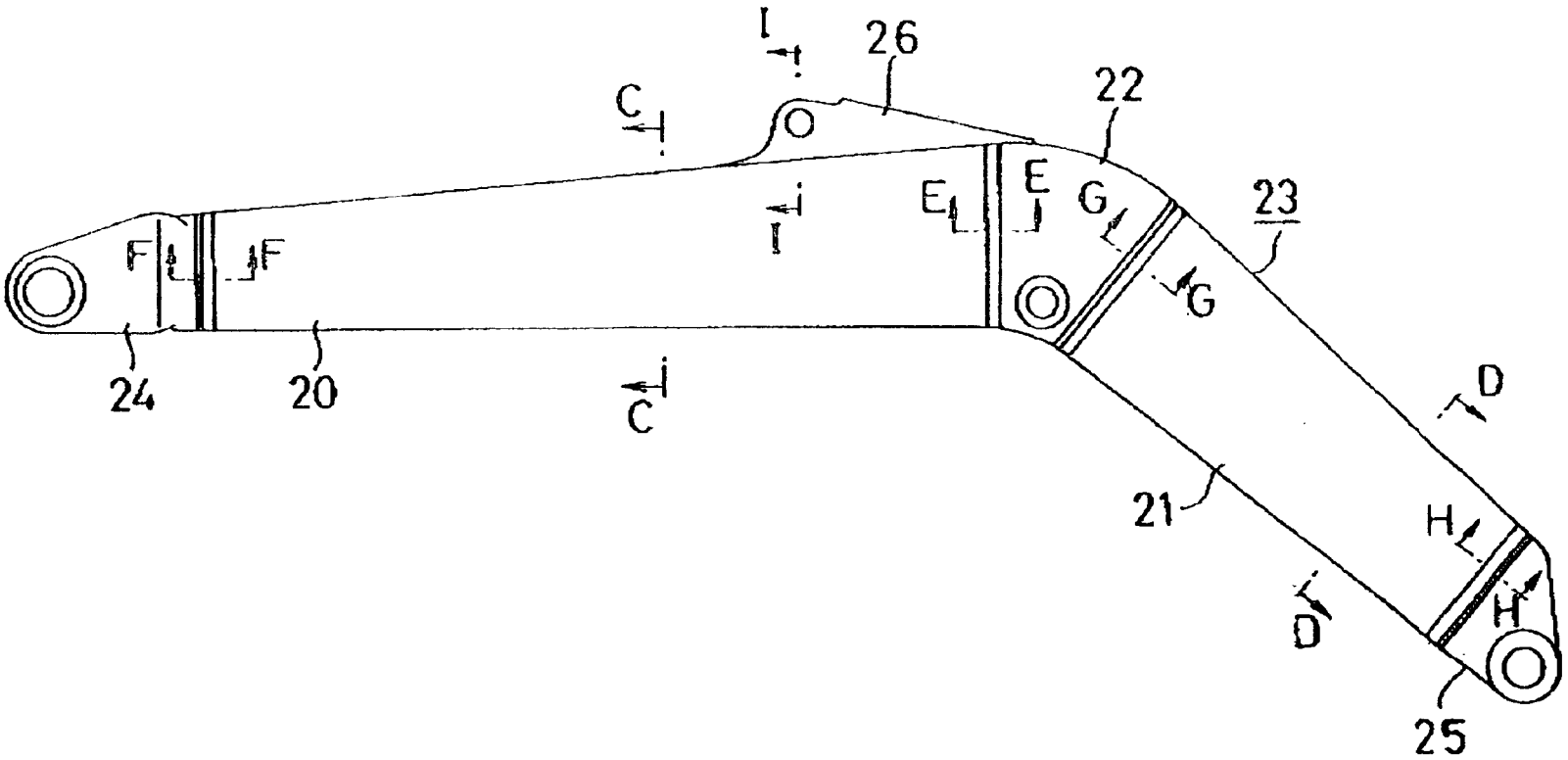
FIG. 7 is a front view of a boom of an embodiment of the present invention.

As shown in FIG. 7, a boom front member 20 and a boom rear member 21 are jointed at a boom intermediate member 22, thereby forming a boom body 23 of boomerang shape as viewed from side whose front side is curved downward from the intermediate member 22. An arm-connection bracket 24 is jointed to the boom front member 20, a vehicle body-mounting bracket 25 is jointed to the boom rear member 21, and an arm cylinder bracket 26 is jointed to a top of the boom front member 20, thereby forming the boom.

Figure 8:
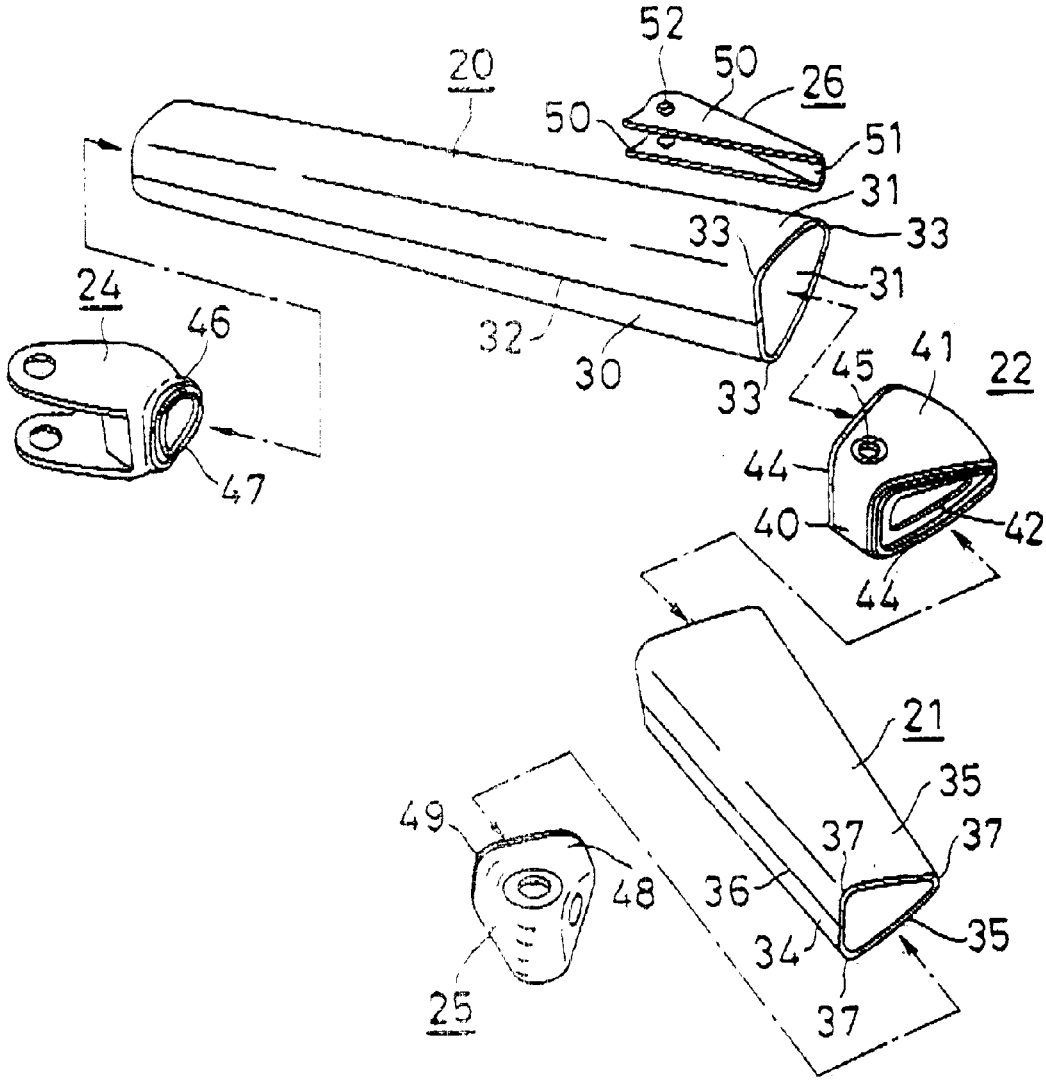
FIG. 8 is an exploded perspective view of the boom.
Figure 9:
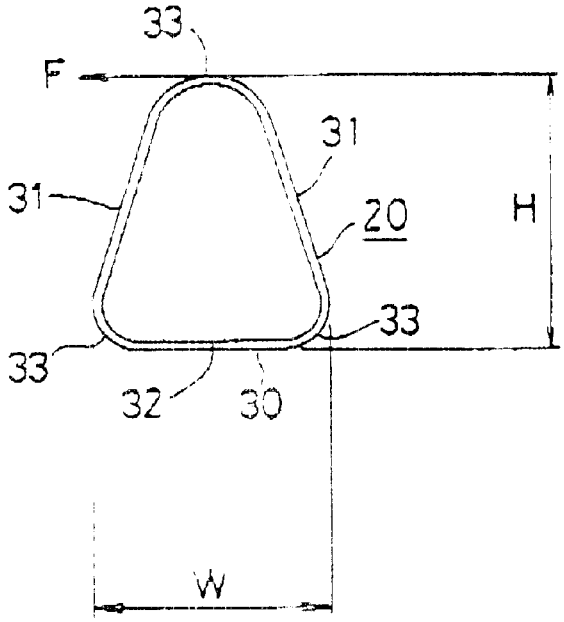
FIG. 9 is a sectional view taken along the line C—C in FIG. 7.

As shown in FIGS. 8 and 9, the boom front member 20 is formed into a hollow long shape having a triangle cross section by a lower lateral plate 30 and left and right vertical plates 31 and 31. More specifically, one sheet of plate material is bent and butt-welded, the cross section is formed into an isosceles triangle shape, and its welded portion 32 is continuously connected to a lower lateral plate (base of the triangle) in the longitudinal direction.

The height H of the boom front member 20 is greater than the width W, three sides of the boom front member 20 are straight, connected portions 33, 33, 33 of two sides are arcuate in shape, a curvature of an upper arcuate portion 33 is greater than those of the lower arcuate portions 33, 33. With this structure, stress applied to each of the connected portions 33 is dispersed, a cross section performance required for a beam is secured, and vertical rigidity of the boom front member 20 is enhanced.

Figure 10:
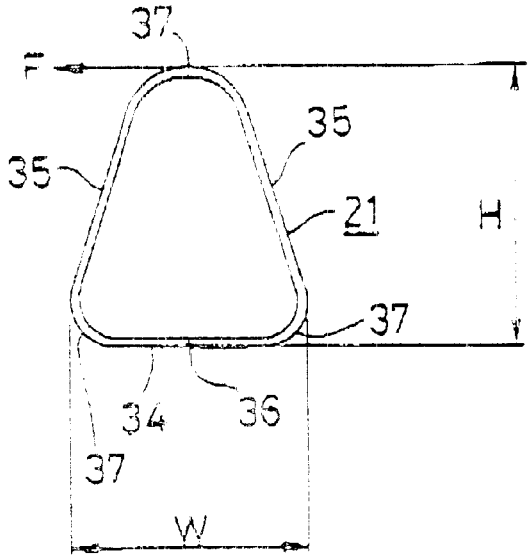
FIG. 10 is a sectional view taken along the line D—D in FIG. 7.

As shown in FIGS. 8 and 10, the boom rear member 21 is formed into a hollow long shape having a triangular cross section by a lower lateral plate 34 and left and right vertical plates 35 and 35. More specifically, one sheet of plate material is bent and butt-welded, the cross section is formed into isosceles triangle shape, and its welded portion 36 is continuously connected to a lower lateral plate (base of the triangle) in the longitudinal direction.

The height H of the boom rear member 21 is greater than the width W, three sides of the boom rear member 21 are straight with arcuate portions connected 37, 37, 37, a curvature of an upper arcuate portion 37 is greater than those of the lower arcuate portions 37, 37. With this structure, stress applied to each of the connected portions 37 is dispersed, a cross section performance required for a beam is secured, and vertical rigidity of the boom rear member 21 is enhanced.

Figure 11:
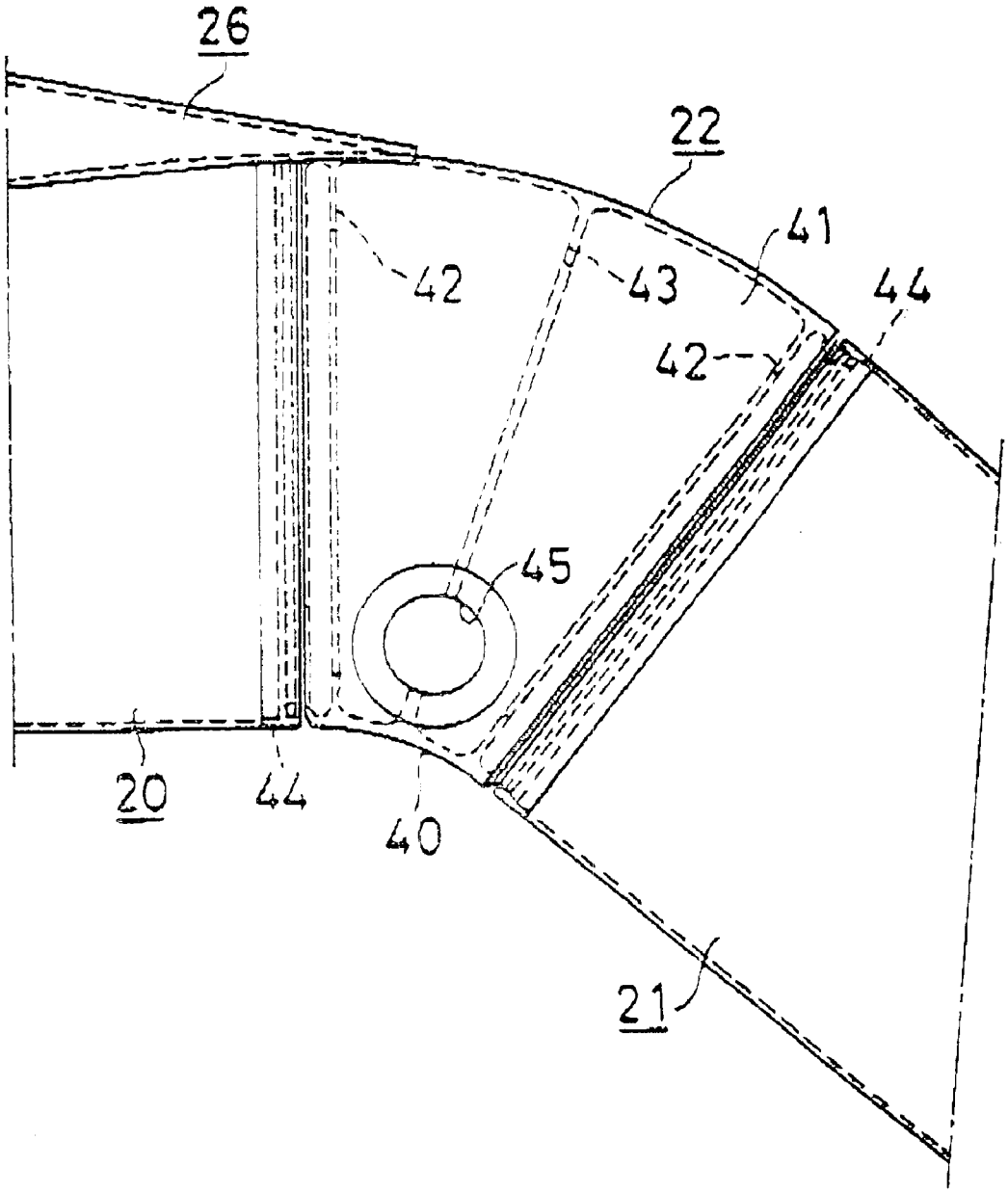
FIG. 11 is a front view of a boom intermediate member.

The boom intermediate member 22 is made of cast steel, and as shown in FIGS. 8 and 11, the boom intermediate member 22 is formed such that a cross section thereof is formed into a triangular shape by a lower lateral plate 40 and opposite vertical plates 41 and 41, and the boom intermediate member 22 is formed into a hollow shape which is curved like a boomerang as viewed from side. The boom intermediate member 22 is integrally provided at its inner surface of opposite ends closer to the openings with end projections 42 and 42, and inner surfaces of intermediate portions 44 are integrally provided with an intermediate projection 43, and the opposite vertical plates 42 and 42 are formed with a boom cylinder-connection pin fitting hole 45 which are opposed to each other. The end projections 42, 42 and the intermediate projection 43 are provided for enhancing the run at the time of casting. The intermediate projection 43 is provided such as to bisect the boom intermediate member 22 from a center of the boom cylinder-connection pin fitting hole 45 toward the top.

The arm-connection bracket 24 is made of cast steel and as shown in FIG. 8, a triangular connection portion 46 is integrally provided at its end surface with a triangular connection projection 47. The vehicle body-mounting bracket 25 is made of cast steel and as shown in FIG. 8, a triangular connection portion 48 is integrally provided at its end surface with a substantially triangular connection projection 49.

As shown in FIG. 8, the arm cylinder bracket 26 is formed such that a pair of vertical pieces 50 and 50 are connected to each other through a lateral piece 51, and each of the pair of vertical pieces 50 and 50 is formed with a pin hole 52.

Figure 12:
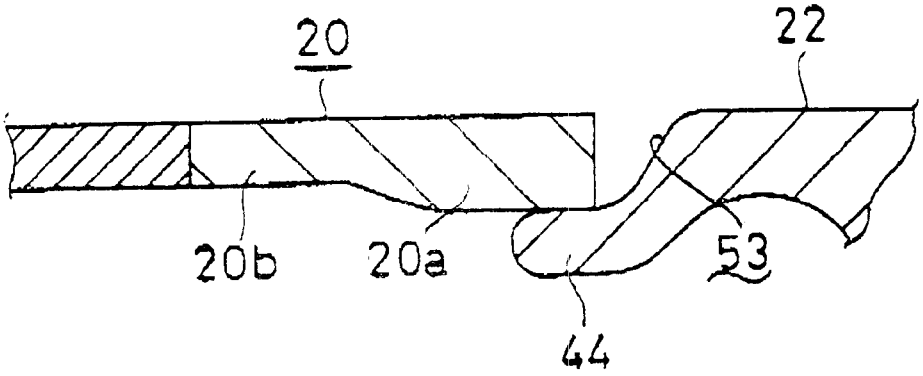
FIG. 12 is a sectional view taken along the line E—E in FIG. 7.

As shown in FIG. 12, the boom front member 20 and the boom intermediate member 22 are formed such that one longitudinal end opening edge of the boom front member 20 is fitted to one of the connection projections 44 to form a welding groove 53, and this portion is welded. One longitudinal end edge 20*a* of the boom front member 20 is formed thicker than other portion 20*b* so that throat depth of the weld joint is secured to obtain sufficient welding depth and the portion can be welded strongly. With this structure, it is possible to reduce the plate thickness of the boom front member 20 to reduce its weight, and to weld strongly.

Figure 13:
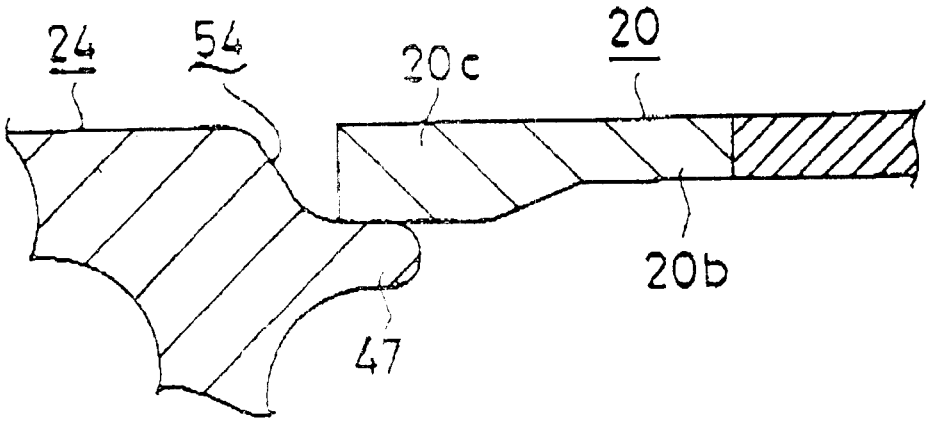
FIG. 13 is a sectional view taken along the line F—F in FIG. 7.

As shown in FIG. 13, the boom front member 20 and the arm-connection bracket 24 are formed such that the other longitudinal end opening edge of the boom front member 20 is fitted to the connection projection 47 of the arm-connection bracket 24 to form a welding groove 54, and this portion is welded. The other longitudinal end edge 20*c* of the boom front member 20 is formed thicker than other portion 20*b* so that throat depth of the weld joint is secured to obtain sufficient welding depth and the portion can be welded strongly. With this structure, it is possible to reduce the plate thickness of the boom front member 20 to reduce its weight, and to weld strongly.

Figure 14:
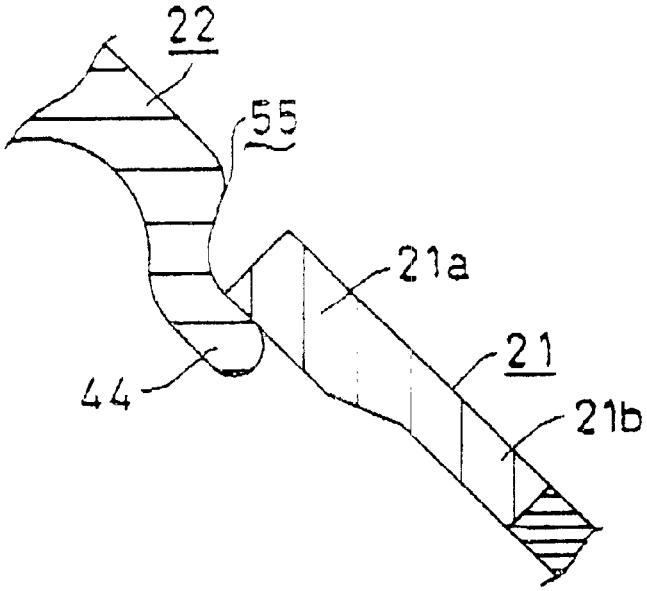
FIG. 14 is a sectional view taken along the line G—G in FIG. 7.

As shown in FIG. 14, the boom rear member 21 and the boom intermediate member 22 are formed such that one longitudinal end opening edge of the boom rear member 21 is fitted to the other connection projection 44 of the boom intermediate member 22 to form a welding groove 55, and this portion is welded. One longitudinal end edge 21*a* of the boom rear member 21 is formed thicker than other portion

21*b* so that throat depth of the weld joint is secured to obtain sufficient welding depth and the portion can be welded strongly. With this structure, even if the plate thickness of the boom rear member 21 is reduced to reduce its weight, it is possible to weld strongly.

Figure 15:
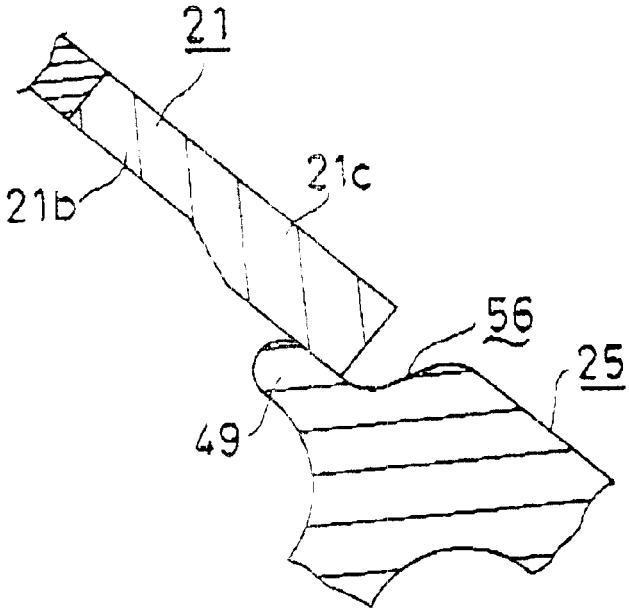
FIG. 15 is a sectional view taken along the line H—H in FIG. 7.

As shown in FIG. 15, the boom rear member 21 and the vehicle body-mounting bracket 25 are formed such that the other longitudinal end opening edge of the boom rear member 21 is fitted to the connection projection 49 of the vehicle body-mounting bracket 25 to form a welding groove 56, and this portion is welded. The other longitudinal end edge 21*c* of the boom rear member 21 is formed thicker than the other portion 21*b* so that throat depth of the weld joint is secured to obtain sufficient welding depth and the portion can be welded strongly. With this structure, even if the plate thickness of the boom rear member 21 is reduced to reduce its weight, it is possible to weld strongly.

Figure 16:
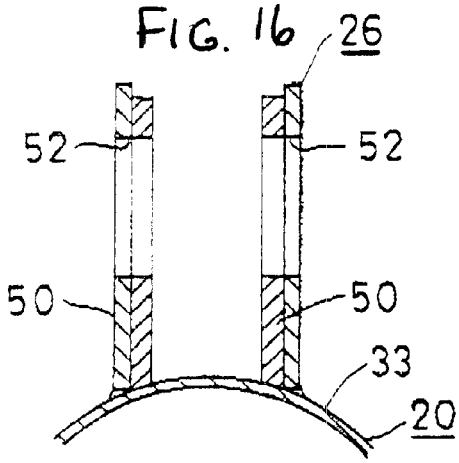
FIG. 16 is a sectional view taken along the line I—I in FIG. 7.

As shown in FIG. 16, the arm cylinder bracket 26 comprises the pair of vertical pieces 50 and 50 welded to the upper arcuate connected portion 33 (top) of the boom front member 20. With this structure, the rigidity of the mounting portion of the arm cylinder bracket 26 of the boom front member 20 is secured, and even if the plate thickness of this portion is thin, it is not deformed by reaction force of the arm cylinder.

Figure 17:
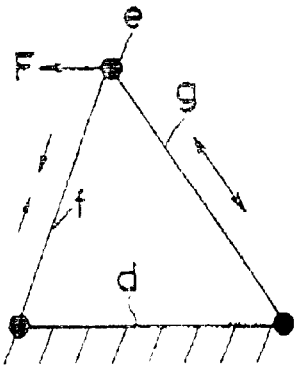
FIG. 17 is an explanatory view of a deformation of a cross section of the boom.

As described above, each of the boom front member 20, the boom rear member 21 and the boom intermediate member 22 constituting the boom has triangular cross section, unlike the rectangular cross section, an element which determines a deformation strength of a cross section is determined only by the rigidity in the inward direction of surface of each of sides of the triangle. For example, in FIGS. 9 and 10, when the base is fixed and the load F shown with the arrow is applied to the top, as schematically shown in FIG. 17, a compressing force is applied to one side f connecting the base d and the top e with each other, and the side f is shrunk and deformed, and a tensile strength is applied to the other side g and the side g is extended and deformed, and no force in the outward direction of surfaces is applied to the two sides f and g. On the other hand, since rigidity (rigidity in the inward direction of the surface) against the tensile and compressing force of the sides f and g is greater than the bending force in the outward direction of the surface, the rigidity of cross section of the boom having the triangular cross section is greater than that of the boom having the rectangular cross section.

In the general formula of the material mechanics, in the case of the strength of the working machine, if the size of the cross section is increased, strength of cross section can be secured even if the cross section is rectangular or triangular. However, if deformation of the cross section is taken into consideration as described above, in the case of the rectangular cross section, the rigidity of the corner and the rigidity of the side in the outward direction of the surface are lowered in proportion to reduction of the plate thickness. Whereas, in the case of the triangular cross section, the rigidity is lowered in proportion to a reduction ratio of the plate thickness. Therefore, variation in rigidity of the cross section due to the reduction in plate thickness of a boom having a triangular cross section is smaller than that of a boom having a rectangular cross section.

For the above reason, if a boom has a triangular cross section, even if the plate thickness is reduced, it is possible to remarkably reduce the deformation of the cross section as compared with the conventional structure having a rectangular cross section, and from this fact, it is possible to reduce the boom in weight.

Figure 18:
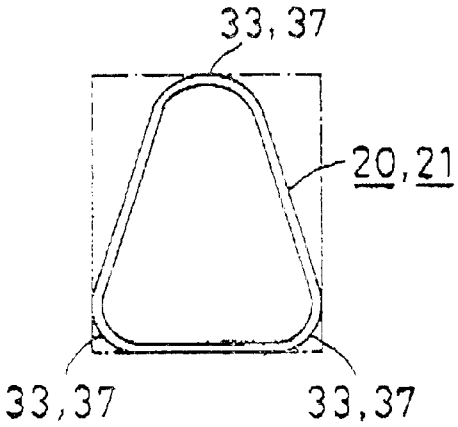
FIG. 18 is an explanatory view of a size of the cross section of the boom.

Further, as shown in FIGS. 9 and 10, since the connected portions 33 and 37 of the two sides are arcuate triangular in cross section, the cross section of the boom can be increased and the sufficient cross section performance can be secured. That is, as shown with a phantom line in FIG. 18, the cross section can be increased by inscribing the arc connected portions 33 and 37 with rectangular inner surfaces of a space (height and width of the cross section) limited by disposition of the working machine on a machine, visual recognition properties of an operator and the like.

Figure 1:
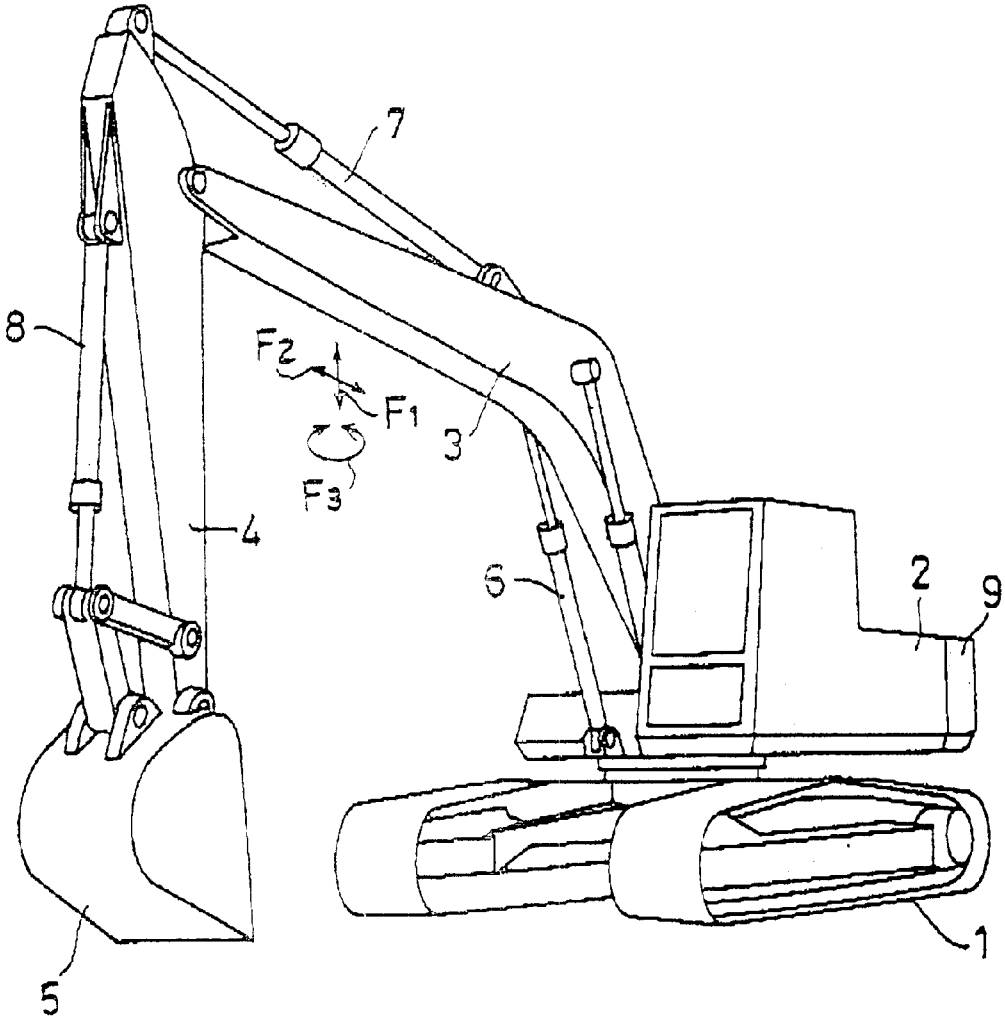
FIG. 1 is a perspective view of a power shovel.
Figure 2:
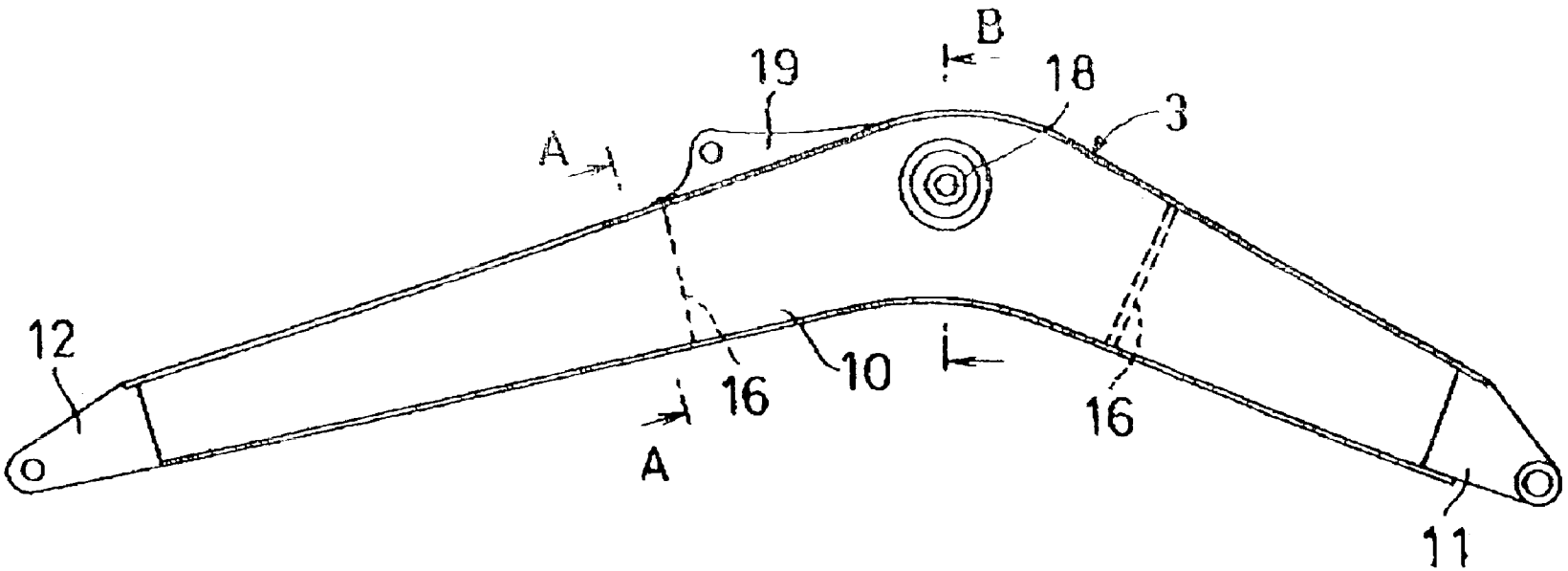
FIG. 2 is a front view of a conventional boom.
Figure 3:
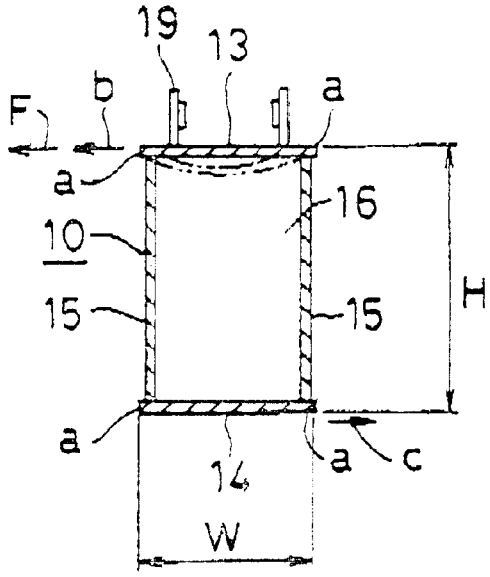
FIG. 3 is a sectional view taken along the line A—A in FIG. 2.
Figure 4:
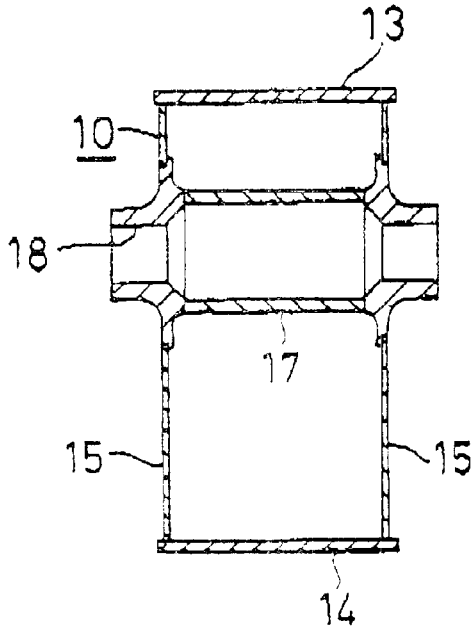
FIG. 4 is a sectional view taken along the line B—B in FIG. 2.
Figure 5:
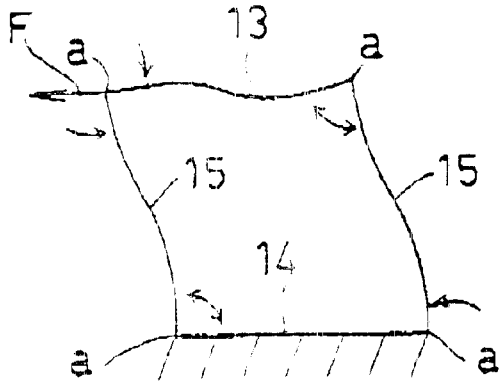
FIG. 5 is an explanatory view of a deformation of a cross section of the boom.
Figure 6:
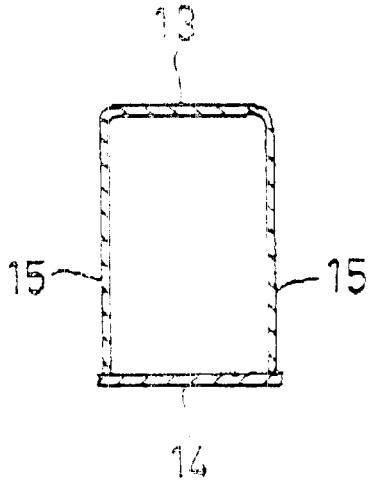
FIG. 6 is a sectional view showing another example of the boom.

When the boom is curved into the boomerang shape and a vertical size of its intermediate portion is greater than those of opposite ends, if a lateral load (F2 in FIG. 1) or a torsion load (F3 in FIG. 1) is applied to a tip end of the boom, length of a force transmitting path of the upper surface side is longer than that of the lower surface side and therefore, there is a tendency that a burden of a load of the lower surface side which is shorter in length is greater. Therefore, as described above, if the lower surface is formed into a base of a triangle, the cross section performance can be exhibited more efficiently as compared with a structure which is turned upside down, and the weight can further be reduced. When the weight reduction is taken into consideration, it is advantageous that the base is disposed at the shorter lower surface side as compared with a case in which the base having great weight is disposed at the longer upper surface side.

Further, when a vertical load (F1 in FIG. 1) is applied to such a boom, a portion of the boom body 23 which is closer to the front end than the pin fitting hole 45 receives a burden of load at its lower surface, and a portion of the boom body 23 which is closer to the vehicle body than the pin fitting hole 45 receives the burden of load at its upper surface side, but the tensile load on the front lower surface side, and the compressing load on the vehicle body side upper surface side are great. In terms of strength, since the tensile load is greater than the tensile load, if the cross section shape of the boom body 23 is formed such that its lower surface becomes a base side, it is advantageous with respect to deformation. It is necessary to guard against surface buckling for a portion where the compressing load is great (vehicle body side upper surface side), and it is advantageous against deformation such as surface buckling by disposing the top of the triangle on the above-described portion rather than disposing the base surface on this portion.

Figure 19:
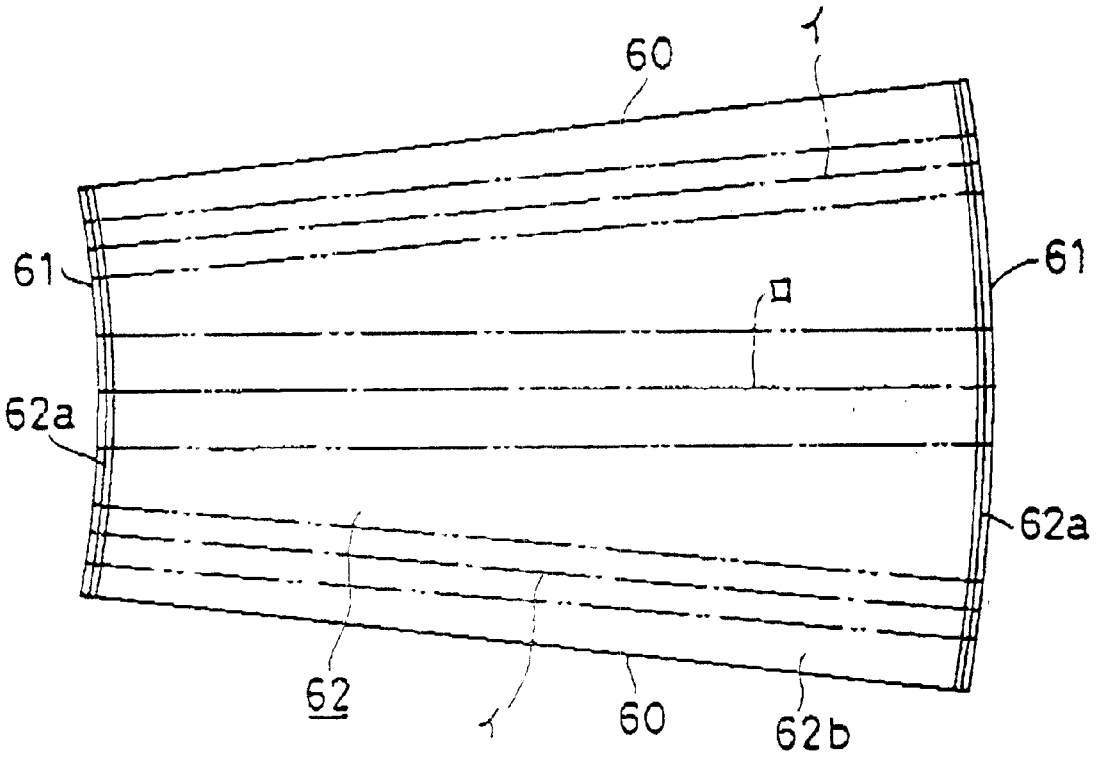
FIG. 19 is a plan view of a plate material for producing a boom front member.

Next, a method for making the boom front member 20 will be explained. As shown in FIG. 19, a steel plate is cut into a substantially rectangular (shape of developed boom front member 20) plate material 62 which is surrounded by two opposed long sides 60, 60, and two opposed short sides 61, 61. A thickness of the plate material 62 is set such that opposite ends 62*a*, 62*a* of the short sides 61 are thicker than other portion 62*b*.

Figure 20:
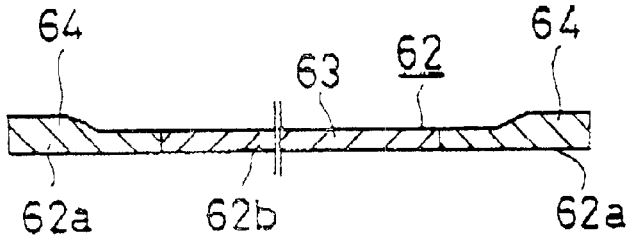
FIG. 20 is a vertical and lateral sectional view of a central portion of FIG. 19.

More specifically, as shown in FIG. 20, bar materials 64 having thick portions and thin portions are jointed, by penetration-welding, to longitudinally opposite ends of a plate 63 which is cut into a predetermined shape, and this jointed plate is designated to be plate material 62. Since one end opening edge of the boom front member 20 is larger than the other end opening edge, one of the short sides 61 is longer than the other short side 61, and each of the short sides 61 and 61 is formed into a V-shape while defining the center in widthwise direction as a boundary.

Figure 21:
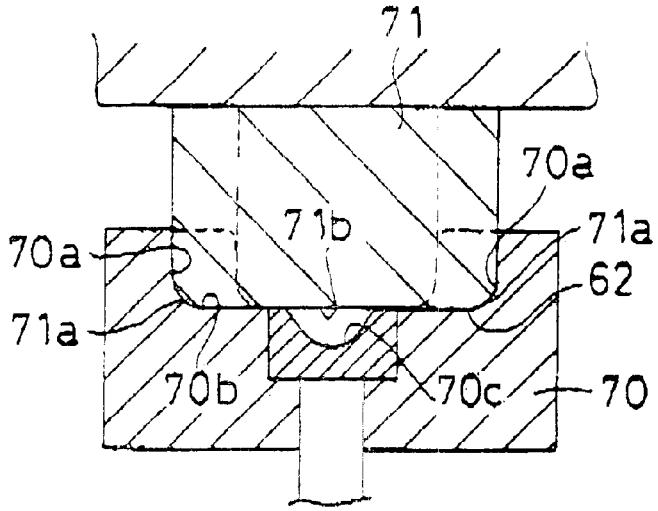
FIG. 21 is an explanatory view of a plate material bending operation.
Figure 22:
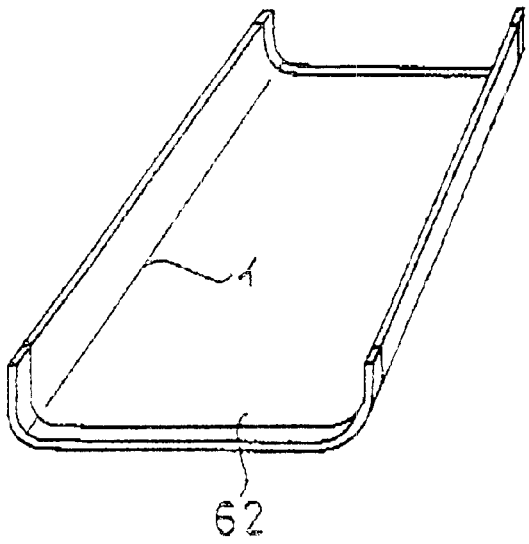
FIG. 22 is a perspective view of the plate material bent in the FIG. 21 operation.

Next, as shown in FIG. 21, using a die 70 having two arcuate surfaces 70*a*, 70*a* and a straight surface 70*b* connecting the arcuate surfaces 70*a*, 70*a*, and having an arcuate surface 70*c* of a large curvature located at the center of the straight surface 70*b*, and using a punch 71 having two arcuate surfaces 71*a*, 71*a* and a straight surface connecting the two arcuate surfaces 71*a*, 71*a*, the plate material 62 is bent into arcuate shape along bending lines A closer to the long sides of the plate material 62, thereby forming the plate material 62 into a substantially U-shape as shown in FIG. 22.

Figure 23:
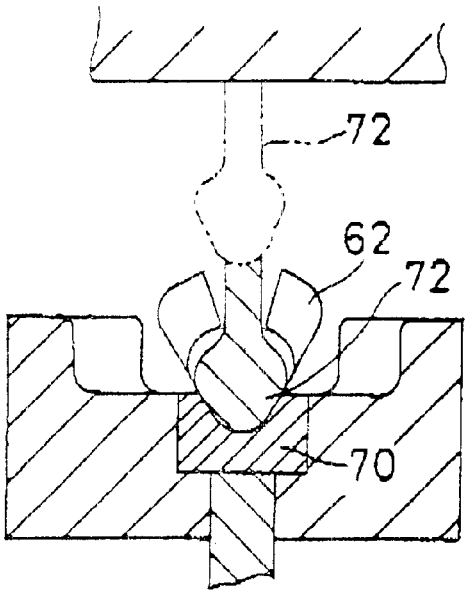
FIG. 23 is an explanatory view of another plate material bending operation.
Figure 24:
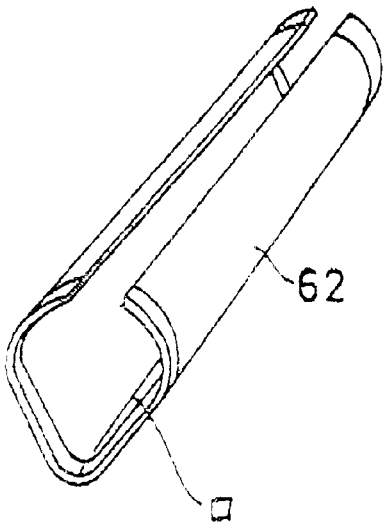
FIG. 24 is a perspective view of the plate material bent in the FIG. 23 operation.

Next, as shown in FIG. 23, a center of the plate material 62 is bent into an arcuate shape along a bending line B using the die 70 and another punch 72, thereby forming the plate material 62 into a substantially rhombus shape, as shown in FIG. 24. Since the same die is used in this manner, a deviation in position is not generated and thus, the bending working precision can be secured.

Figure 25:
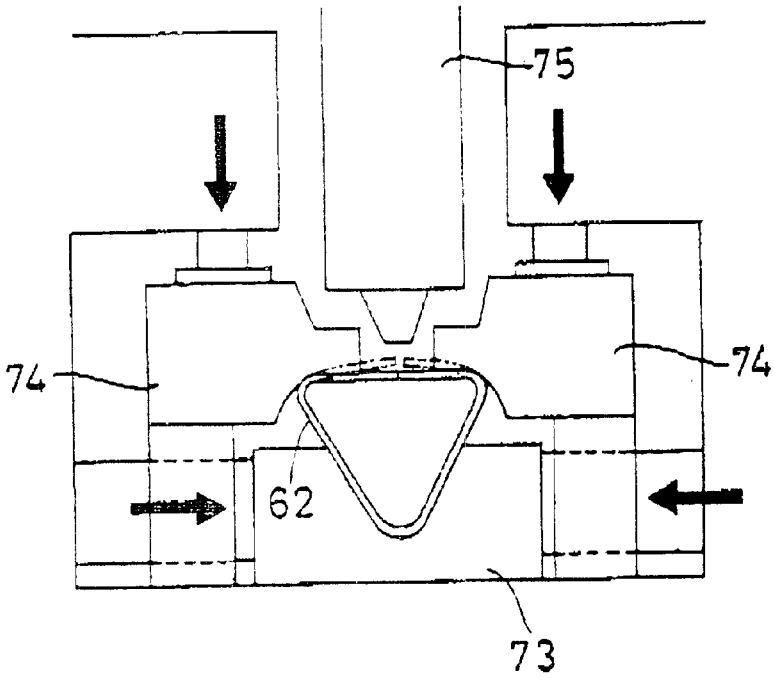
FIG. 25 is an explanatory view of bending and jointing operations of the plate material.
Figure 26:
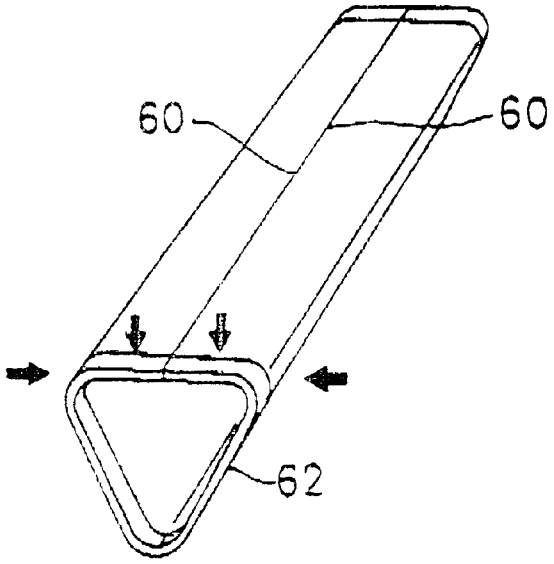
FIG. 26 is a perspective view showing jointed plate material.

Next, as shown in FIG. 25, the bend plate material 62 is set on a die 73, a pair of punches 74, 74 are moved laterally and vertically, thereby bending the plate material 62 into a triangular shape, and the two long sides 60, 60 of the plate material 62 are butted as shown in FIG. 26. While keeping this state, a welding torch 75 is moved along a space between the pair of punches 74 and 74 to weld the butted portion.

Since the plate 62 is bent and formed into the final shape and welded simultaneously in this manner, the butt precision of the welding portion can be secured.

The boom rear member 21 is produced in substantially the same manner as the boom front member 20.

Figure 27A:
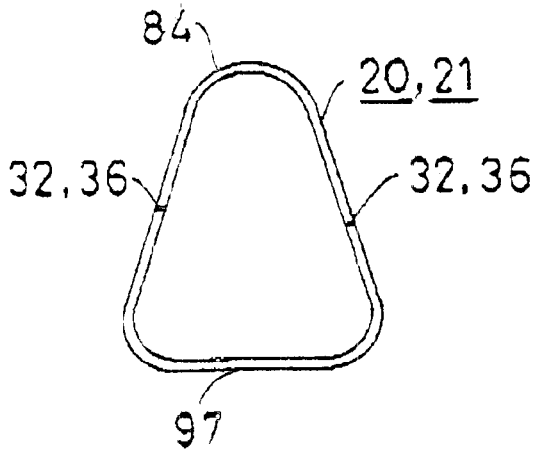
FIGS. 27(*a*)–(*c*) are sectional views showing different examples of a boom front member and a boom rear member.
Figure 27B:
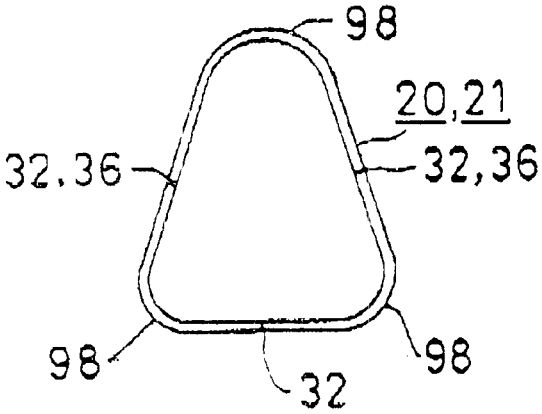
Figure 27:
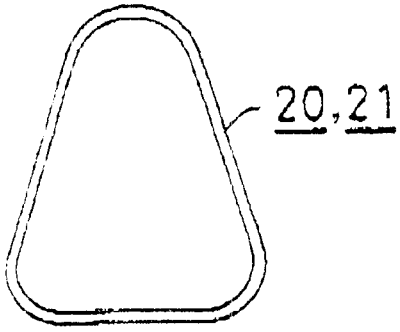

The boom front member 20 and the boom rear member 21 may be produced using two plate materials as shown in FIG. 27(*a*), or three plate materials as shown in FIG. 27(*b*), or each of the members 20 and 21 may be integrally formed in a seamless manner.

Figure 28:
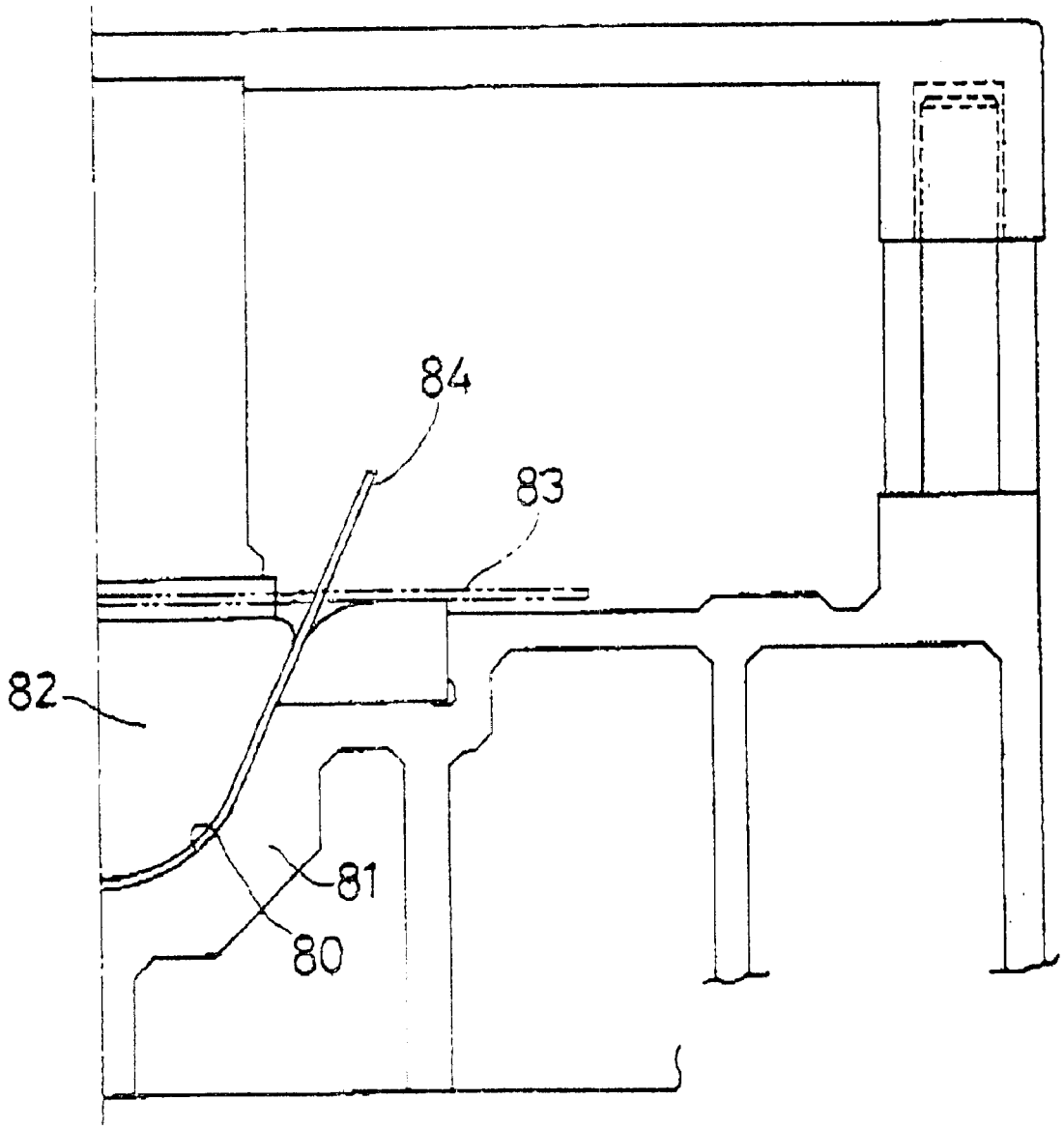
FIG. 28 is an explanatory view of bending operation of a top cross member.

When the member is produced using two plate materials as shown in FIG. 27(*a*), as shown in FIG. 28, one plate material 83 is bent to form a top side member 84 using a die 81 having a recess 80 whose base portion is of arcuate and substantially V-shape, and a punch 82 having the same shape as that of the recess 80.

Figure 29:
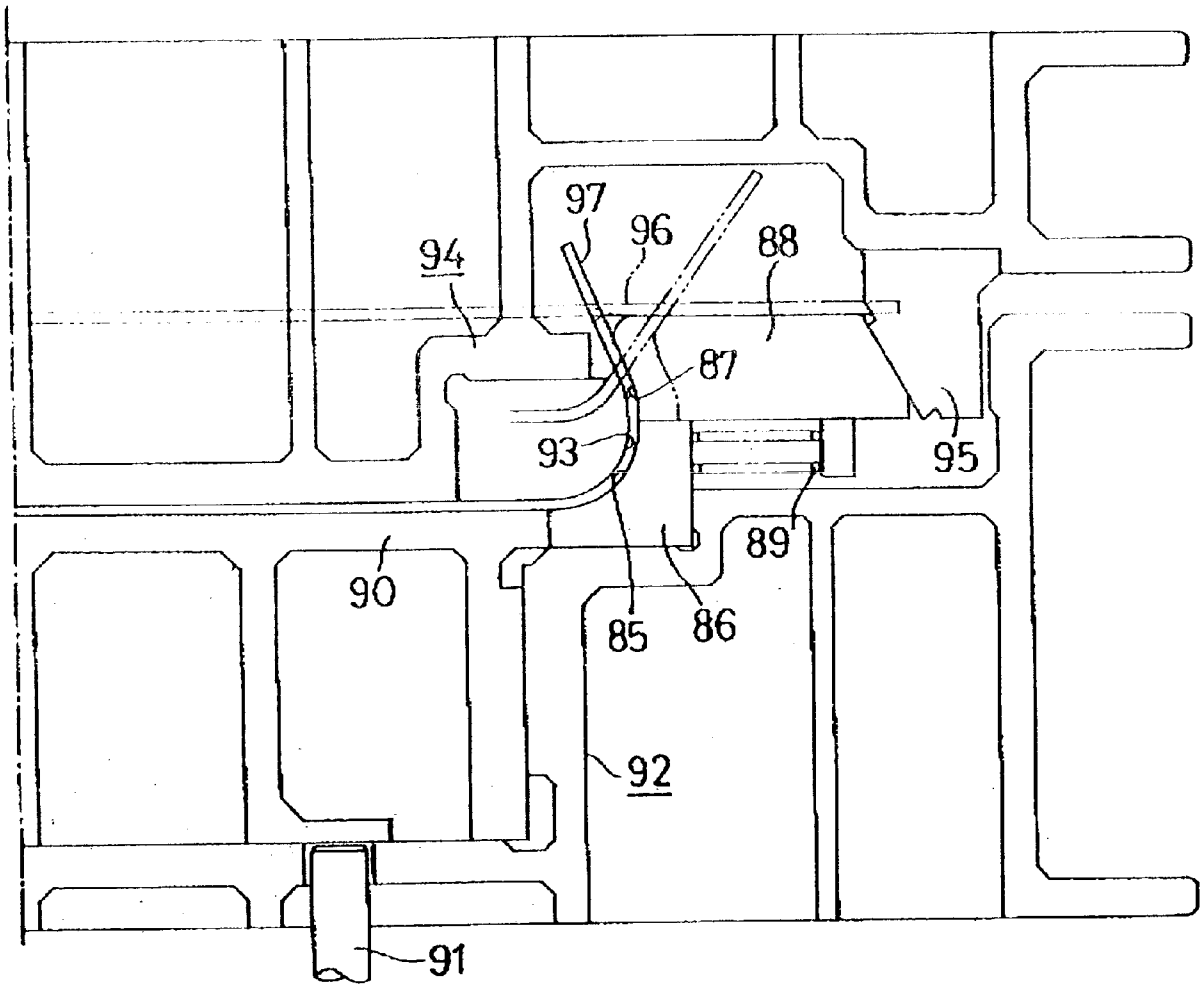
FIG. 29 is an explanatory view of bending operation of a bottom side cross member.

As shown in FIG. 29, a die 92 is formed using a stationary die 86 having an arcuate surface 85, a movable die 88 having an arcuate surface 87 which is continuously connected to the arcuate surface 85, a spring 89 for separating the movable die 88 from the stationary die 86, a cushion pad 90, and a cushion pin 91 for pushing up the cushion pad 90. A punch 94 having an arcuate surface 93 which is the same as the continuous two arcuate surfaces 85 and 87 is provided with a cam which moves against the spring 89. When the punch 94 is in an upper position, the cushion pad 90 is pushed up by the cushion pin 91 and is flush with an upper surface of the movable dice 88.

One plate material 96 is bent using the die 92 and the punch 94, thereby forming a base side member 97. More specifically, the plate material 96 is placed on the movable die 88 and the cushion pad 90, and the punch 94 is lowered. While sandwiching the plate material 96 between the punch 94 and the cushion pad 90, the punch 94 is lowered and the cushion pad 90 is lowered, and opposite ends of the plate material 96 is sequentially bent by an arcuate portion 85 of the stationary die 86.

When the punch 94 is lowered to a predetermined position, the movable die 88 is moved by the cam 95 against the spring 89, the plate material 96 is bent into a predetermined shape, thereby forming the base side member 97.

Figure 30:
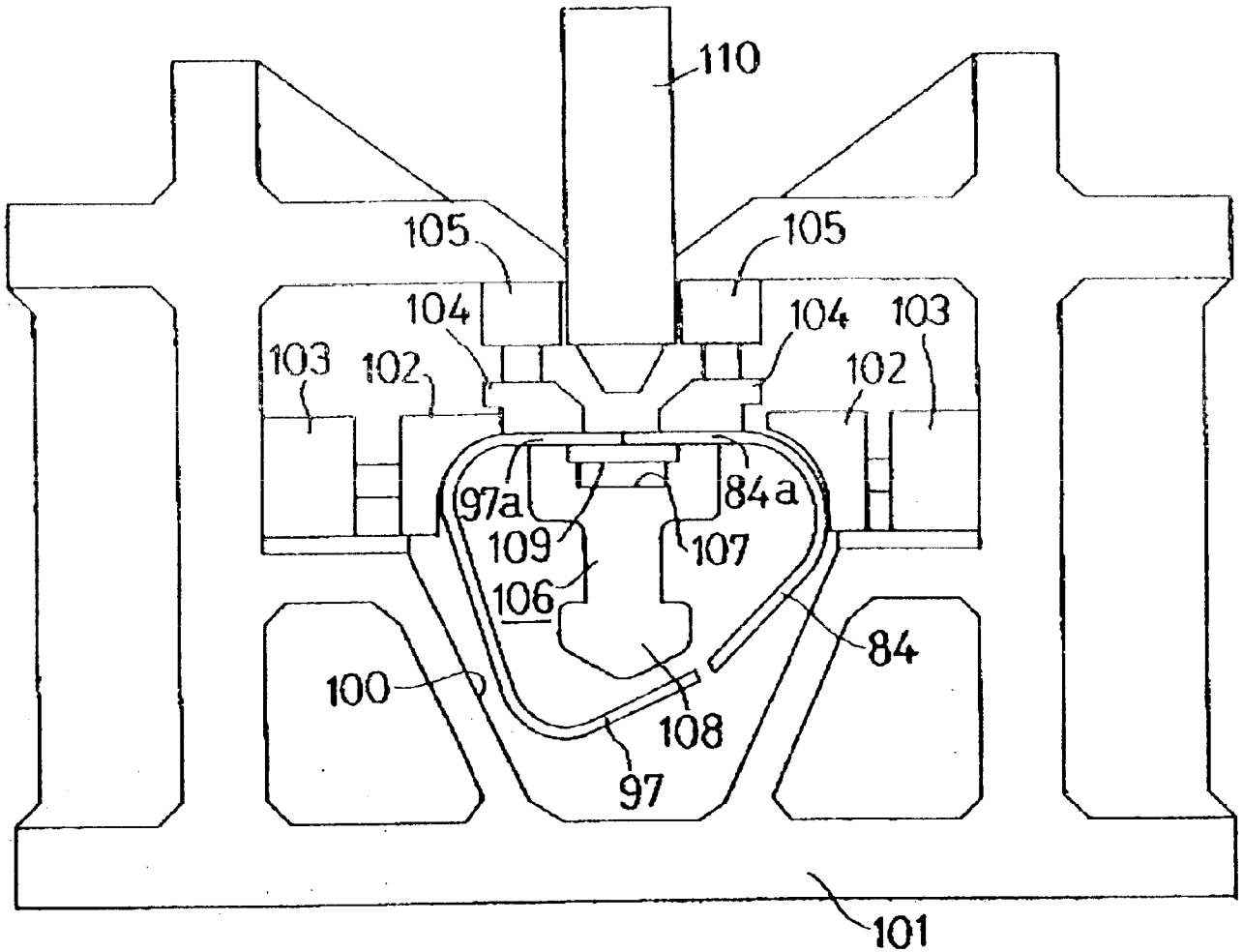
FIG. 30 is an explanatory view of back wave welding operation of one end of both members by a butt jig.

Using a butt-jig shown in FIG. 30, the top side member 84 and the base side member 97 are butted and penetration-welded.

The butt-jig includes a body 101 having a V-shaped groove 100, a pair of side pushing pieces 102, 102 provided on left and right opposite sides of the V-shaped groove 100 of the body 101, a pair of first cylinders 103, 103 for moving the side pushing pieces 102, a pair of upper pushing pieces 104, 104 provided on upper opposite sides of the V-shaped groove 100 of the body 101, a pair of second cylinders 105, 105 for moving the upper pushing pieces 104, 104, and a backing material 106 provided along the V-shaped groove 100 and supported by a supporting shaft (not shown) provided on opposite ends of the body 101.

The backing material 106 includes a water-cooling jacket 107 which is opened at an upper surface of the backing material 106, and a lower supporting portion 108. A receiving plate 109 is mounted to an upper surface of the backing material 106 such as to cover an upper portion of the water-cooling jacket 107. Cooling water flows through the water-cooling jacket 107. A welding torch 110 is movably mounted to an upper portion of he V-shaped groove 100 of the body 101.

Next, the operation of the penetration-welding will be explained. As described above, the bent top side member 84 and base side member 97 are butted into a triangular shape and inserted between the V-shaped groove and the backing material 106.

Each of the side pushing pieces 102 are moved toward the center, each of the upper pushing pieces 104 is moved downward, and one end 84*a* of the top side member 84 and one end 97*a* of the base side member 97 are butted on an upper surface of the receiving plate 109. The welding torch 110 is moved, thereby penetration-welding the butted portion.

Each of the side pushing pieces 102 is moved sideways, each of the upper pushing pieces 104 is moved upward, thereby separating these members, the top side member 84 and the base side member 97 to which the one ends 84*a* and 96*a* are welded are pulled out between the V-shaped groove 100 and the backing material 106.

Figure 31:
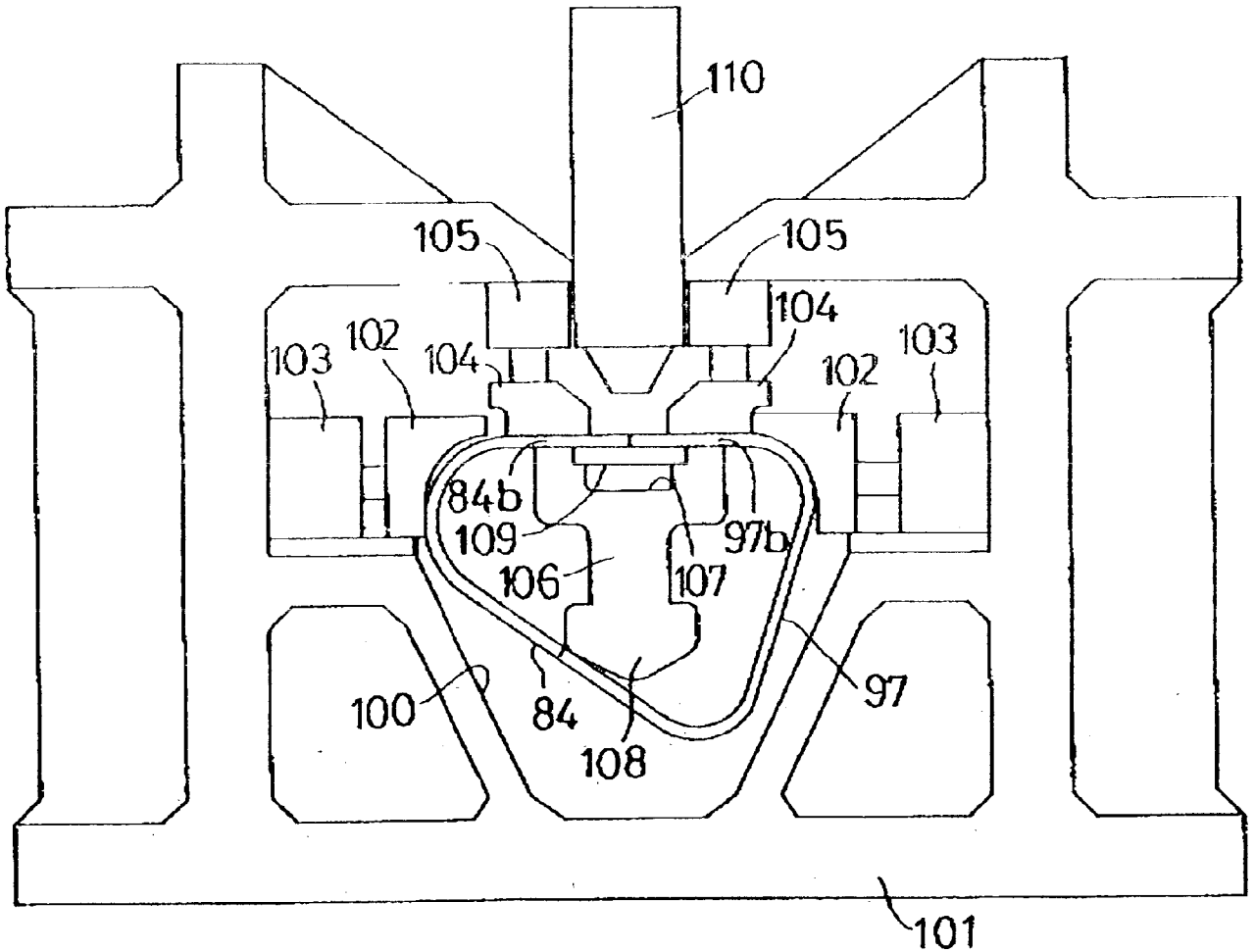
FIG. 31 is an explanatory view of back wave welding operation of another end of both members by a butt jig.

The pulled out top side member 84 and base side member 97 are rotated, and again inserted between the V-shaped groove 100 and the backing material 106 as shown in FIG. 31, and the other ends 84*b* and 97*b* are penetration-welded in the same manner as that described above.

With the above operation, the boom front member 20 and the boom rear member 21 each comprising two members can be produced.

Further, as shown in FIG. 27(*b*), when the boom member is produced using three plate materials, one plate material is bent using the die 81 and the punch 82 shown in FIG. 28, thereby producing three members 98, and the three members 98 are sequentially penetration-welded at three points using the butt-jig shown in FIG. 30, thereby producing the boom member.

Figure 32:
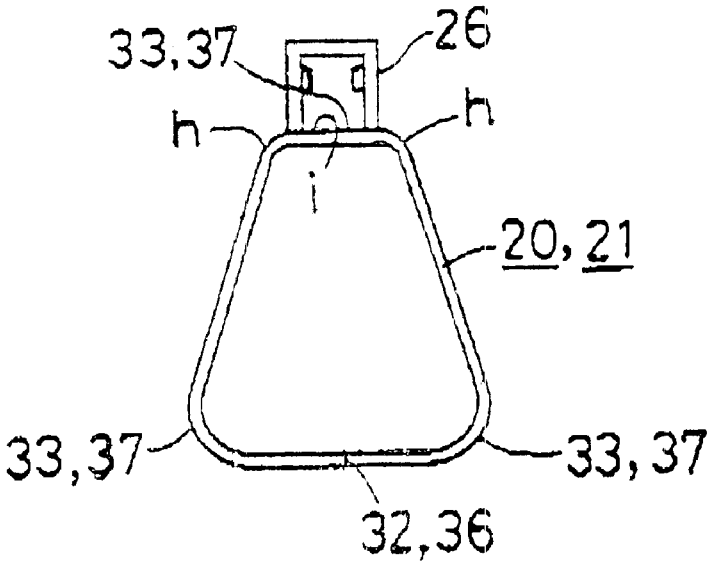
FIGS. 32(*a*) and (*b*) are sectional views showing a different triangular shapes of the boom front member and the boom rear member.
Figure 32:
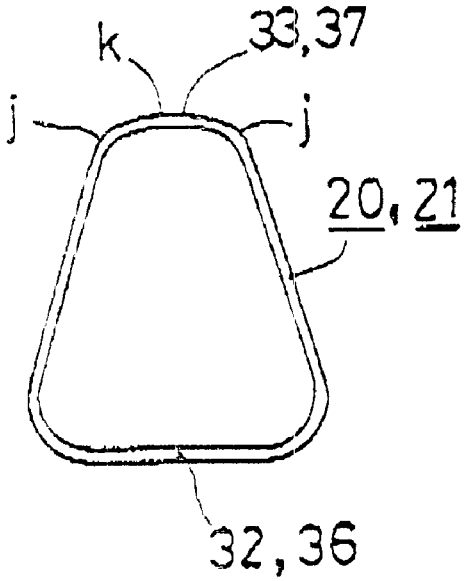

Further, as shown in FIGS. 32(*a*) and (*b*), the boom front member 20 and the boom rear member 21 may be formed such that upper connected portions 33 and 37 are formed by two arcuate portions h, h, a flat portion i and two arcuate portions j, j having small curvature, and an arcuate portion k having large curvature.

Although it is not illustrated, all of the three connected portion, or one of them or two of them may be formed into the above-described shape, or each of the connected portions may have different combination of shape.

If the boom has the flat portion i shown in FIG. 32(*a*), the arm cylinder bracket 26 can be welded to the flat portion i.

Therefore, edge preparation of the arm cylinder bracket 26 is unnecessary and the throat depth of the weld joint can be secured by using a fillet weld joint as the weld joint.

Figure 33:
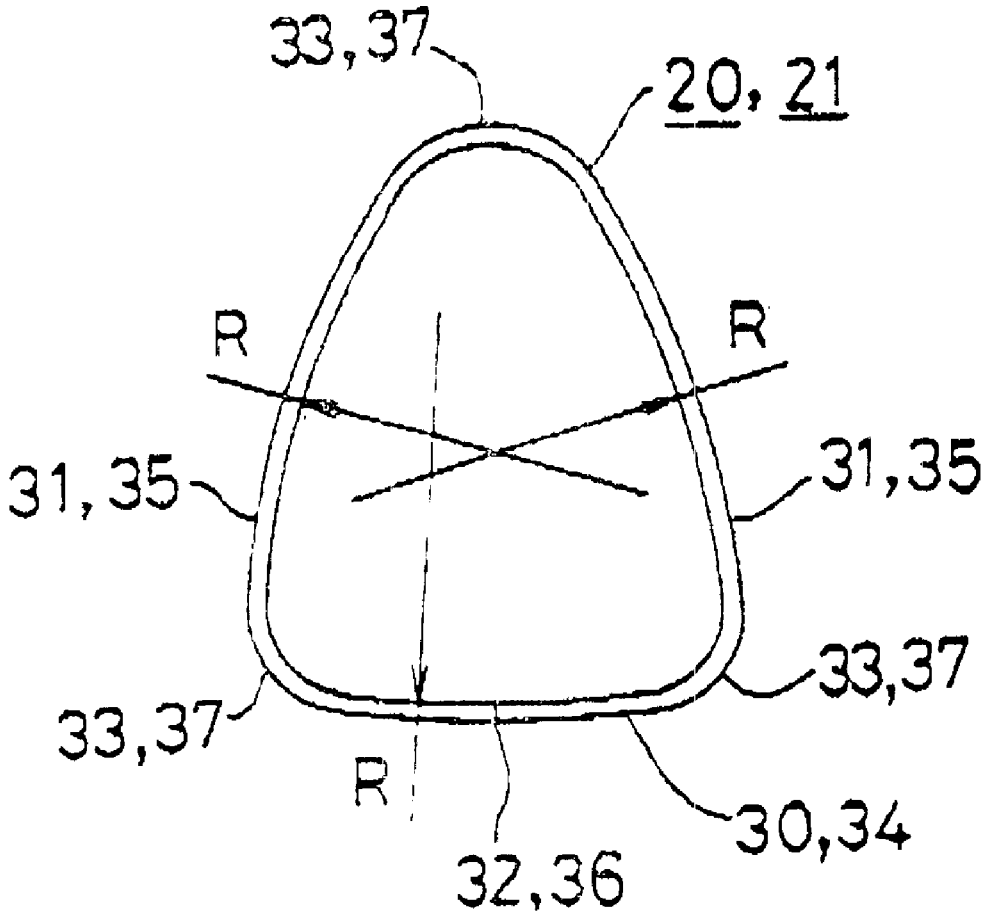
FIG. 33 is a sectional view showing another triangular shape of the boom front member and the boom rear member.

As shown in FIG. 33, each of the boom front member 20 and the boom rear member 21 may have three sides which bulge with large curvature R instead of three straight sides (plate portions 30, 31, 34, 35). Alternately, the three sides may be a combination of bulged side and straight side.

The weld joint and the like are explained on the precondition that MAG (Metal Active Gas) welding method or MIG (Metal Inert Gas) welding method is used, but it is possible to use high energy welding such as laser welding and electron beam welding by changing the weld joint. When a high energy density heat source is used, the thick portions provided on the opening edges 20*a*, 20*c*, 21*a*, 21*c* of the boom front member 20 and the boom rear member 21 may be omitted so that these portions have the same thickness as that of the other portions 20*b*, 21*b*, the connection projections 44, 47 and 49 provided on the boom intermediate member 22, the arm-connection bracket 24 and the vehicle body-mounting bracket 25 may be omitted, and these portions may be butted and penetration-welded.

What is claimed is:

1. A boom for a bucket type excavator comprising:

a rear member;

said rear member being bent from a first steel plate into a first triangular cross section with arcuate corners, a base of said first triangular cross section being disposed at a lower portion thereof, and an apex disposed at an upper portion thereof;

a front member;

said front member being bent from a second steel plate into a second triangular cross section with arcuate corners, a base of said second triangular cross section being disposed at a lower portion thereof, and an apex disposed at an upper portion thereof;

a boom intermediate member;

said boom intermediate member including first means for affixing to an outer end of said rear member;

said boom intermediate member including second means for affixing to an inner end of said front member; and said boom intermediate member having a shape which inclines said front member with respect to said rear member so that said front member, said rear member and said boom intermediate member assume a generally boomerang shape.

2. A boom according to claim 1, wherein said boom intermediate member is cast steel.

3. A boom according to claim 1, wherein at least one of said front member and said rear member includes at least one butt weld longitudinally disposed along a length of at least one of three sides of its triangular cross section to secure said at least one into said triangular cross section into its finished shape.

4. A boom according to claim 3, wherein said at least one of said front member and said rear member includes both said front member and said rear member.

5. A boom according to claim 1, wherein:

said first triangular cross section is an isosceles triangle;

a base of said isosceles triangle being disposed facing downward; and an apex of said isosceles triangle facing upward.

* * * * *